US007699795B2

(12) United States Patent
Nan

(10) Patent No.: US 7,699,795 B2
(45) Date of Patent: Apr. 20, 2010

(54) MASSAGER DEVICE WITH LIQUID APPLICATOR

(75) Inventor: Simon Siu Man Nan, Ontario (CA)

(73) Assignee: Nanma Manufacturing Co., Ltd., Hong Kong (HK)

( * ) Notice: Subject to any disclaimer, the term of this patent is extended or adjusted under 35 U.S.C. 154(b) by 214 days.

(21) Appl. No.: 11/157,630

(22) Filed: Jun. 21, 2005

(65) Prior Publication Data

US 2006/0287616 A1 Dec. 21, 2006

(51) Int. Cl.
*A61H 1/00* (2006.01)
*A61H 1/02* (2006.01)
*A61H 5/00* (2006.01)

(52) U.S. Cl. ..... 601/17; 601/72; 601/131

(58) Field of Classification Search ..... 601/15, 601/17, 131, 46, 38–41; 600/38–41; 128/842, 128/844, 917–918; 401/6, 209–216
See application file for complete search history.

(56) References Cited

U.S. PATENT DOCUMENTS 3,163,166 A * 12/1964 Migliarese et al. ..... 604/20
3,994,290 A * 11/1976 Springer et al. ..... 601/131
4,291,685 A * 9/1981 Taelman ..... 601/17
4,492,223 A 1/1985 Burke
5,105,802 A * 4/1992 Pokorny ..... 601/131
5,520,617 A * 5/1996 Wei ..... 601/134
5,556,468 A * 9/1996 Legrain et al. ..... 118/202
6,350,230 B1 * 2/2002 Kontos ..... 600/38
6,749,557 B2 6/2004 Garland
6,911,010 B2 6/2005 Dirks et al.
2002/0173738 A1 11/2002 Rogalski
2004/0034315 A1 * 2/2004 Chen ..... 601/72
2004/0249320 A1 * 12/2004 Yamazaki et al. ..... 601/46
2005/0249541 A1 * 11/2005 Habatjou ..... 401/220
2006/0029456 A1 * 2/2006 Liu ..... 401/108
2006/0165475 A1 * 7/2006 Kervoalen ..... 401/213

FOREIGN PATENT DOCUMENTS

GB 2220857 A * 1/1990

OTHER PUBLICATIONS

Adam & Eve. http://www.adameve.com/Vibrators/Clit-Vibrators-Vibrators/sp-self-lubricating-vibrator-Vibrators-10851.aspx. Accessed Jun. 29, 2007.*

* cited by examiner

*Primary Examiner*—Danton DeMille
*Assistant Examiner*—Kristen C Matter
(74) *Attorney, Agent, or Firm*—Polsinelli Shughart PC

(57) ABSTRACT

A massager device that provides a liquid applicator that dispenses a liquid and provides a massaging effect is disclosed. The massager device comprises a massage head adapted to engage a reservoir for storing a liquid, a liquid dispensing component engaged to the reservoir for applying the liquid, and a vibratory component for vibrating the massager device such that the user may simultaneously apply the liquid and provide a massaging effect.

19 Claims, 4 Drawing Sheets

MASSAGER DEVICE WITH LIQUID APPLICATOR

FIELD OF THE INVENTION

The present invention relates to a massager device, and more particularly to a massager device capable of applying a liquid.

BACKGROUND OF THE INVENTION

Massager devices for recreational and therapeutic use are well known in the art. If desired, such massager devices may be used in combination with the separate application of lotions, oils and other liquids to the user's skin during a massage. However, such a simultaneous operation requires the user to manage both the liquid applicator and the massager device at the same time which can be cumbersome.

Therefore, there is a need in the art for a massager device that provides a massaging effect and is capable of storing and dispensing a liquid. There is a further need in the art for a massager device capable of providing a massaging effect and dispensing a liquid at the same time.

SUMMARY OF THE INVENTION

A primary object of the present invention is to provide a massager device that allows a user to dispense a liquid and provide a massage effect without the need for separate devices.

A further object of the present invention is to provide a massager device that permits the user to provide a massage effect and dispense a liquid at the same time.

Another object of the present invention is to provide a massager device as noted above that permits interchangeable massage heads.

Yet another object of the present invention is to provide a massager device that is capable of storing and dispensing a liquid.

Still another object of the present invention is to provide a massager device having a liquid dispensing component capable of being sealed after liquid application.

Another further object of the present invention is to provide a massager device with a liquid dispensing component that is simple, reliable and easy to re-fill with a liquid.

In one embodiment, the present invention comprises a massager device comprising a massage head, the massage head adapted to engage a reservoir defining a chamber for storing a liquid, a liquid dispensing component in communication with the reservoir for dispensing the liquid, a vibratory component engaged to the reservoir for providing a massage effect, and an end cap operatively engaged to the vibratory component for controlling the operation of the massager device.

In another embodiment, the present invention comprises a massager device comprising a reservoir defining a chamber for storing a liquid, a liquid dispensing component engaged to the reservoir for dispensing the liquid, and a vibratory component engaged to the reservoir for providing a massaging effect, wherein the massager device is adapted to dispense said liquid and provide a massaging effect at the same time.

In yet another embodiment, the present invention comprises a massage head, the massage head adapted to engage a reservoir defining a chamber for storing a liquid, a liquid dispensing component in communication with the reservoir for dispensing the liquid, the reservoir including a cap member being removable from the reservoir for permitting the chamber to be refilled with the liquid, wherein the massage head has a generally phallic shape.

Additional objects, advantages and novel features of the invention will be set forth in the description that follows, and will become apparent to those skilled in the art upon examination of the following more detailed description and drawings in which like elements of the invention are similarly numbered throughout.

DETAILED DESCRIPTION OF THE INVENTION

Figures 1, 2, 2A:
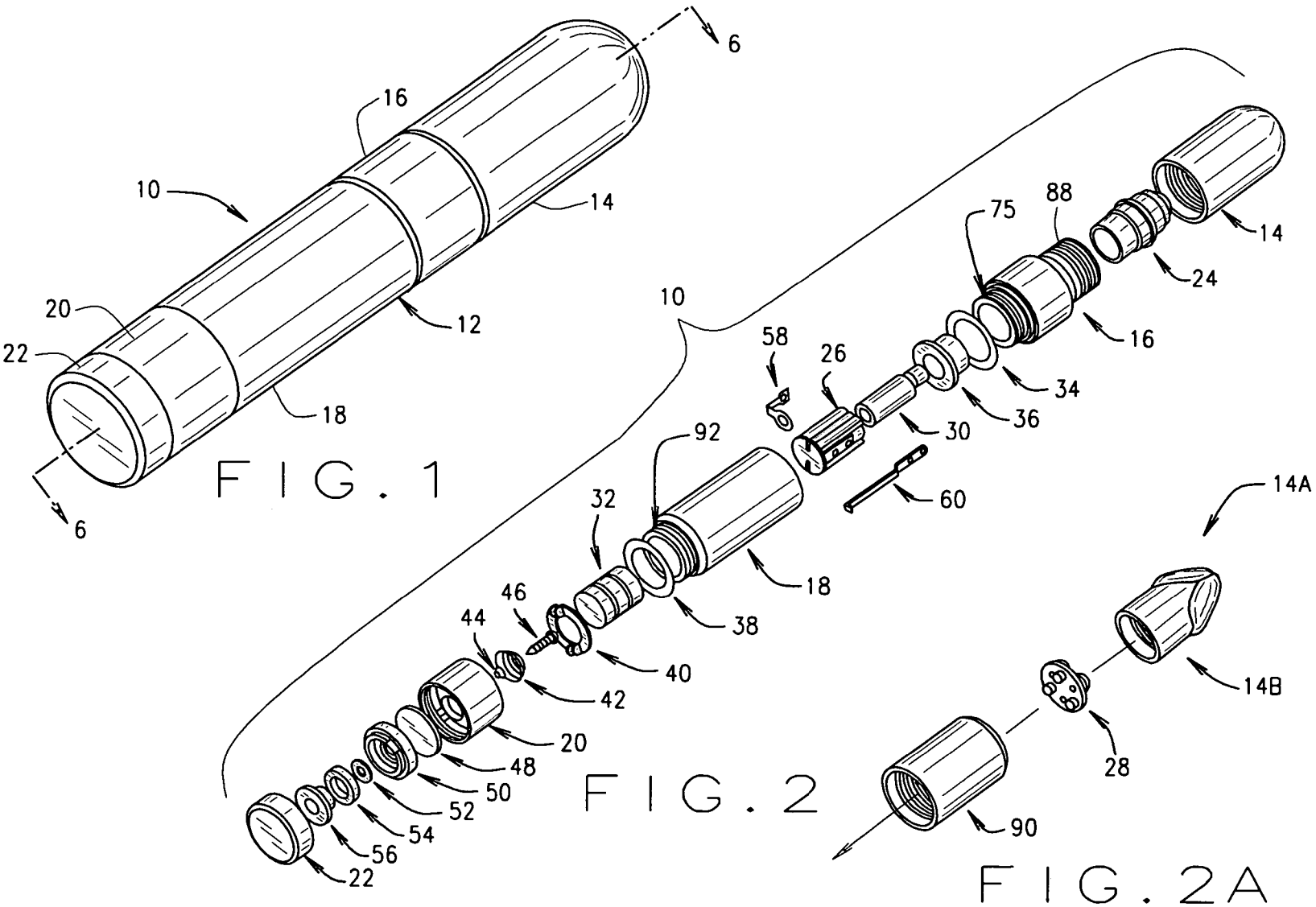
FIG. 1 is an elevated perspective view of the massager device according to the present invention.
FIG. 2 is an exploded view of the massager device according to the present invention.

Referring to the drawings, the massager device with a liquid applicator according to the present invention is illustrated and generally indicated as 10 in FIG. 1. The massager device 10 comprises a body 12 including a massage head 14 that provides a massage effect engageable with a reservoir 16 that stores a liquid 78 for dispensation. As shown, the reservoir 16 is engaged to a vibratory component 18 for providing the massage effect when the massager device 10 is operated using a rotatable end cap 22 operatively engaged to the vibratory component 18 through a battery cover 20.

Figure 3:
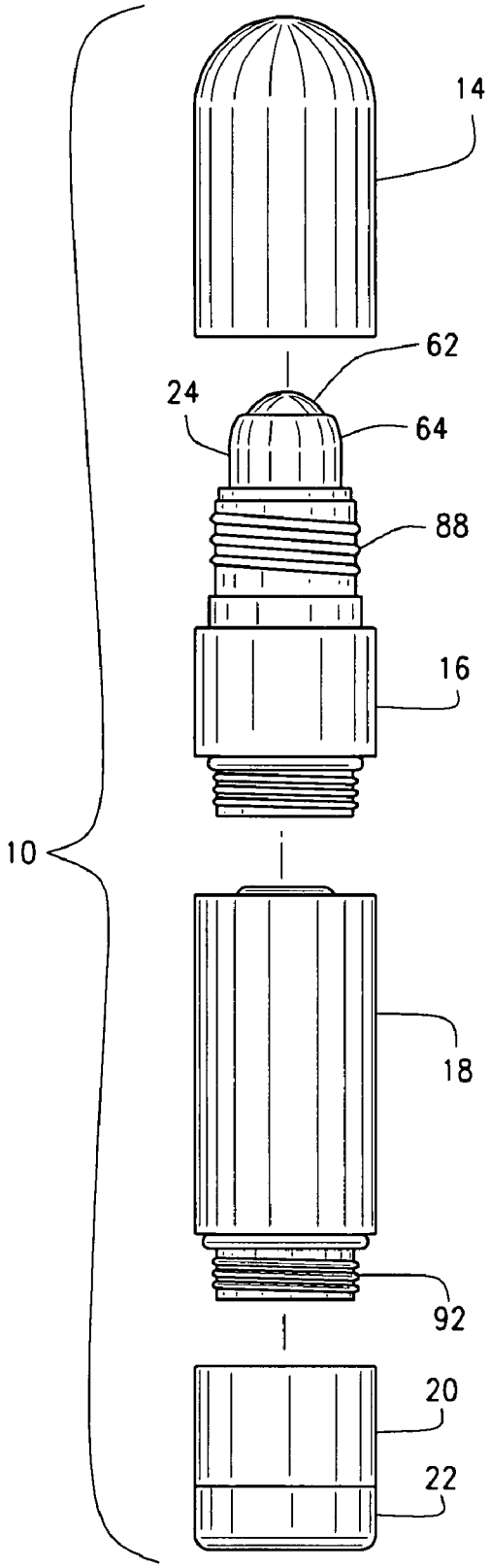
FIG. 3 is another exploded view of the massager device according to the present invention.
Figure 4:
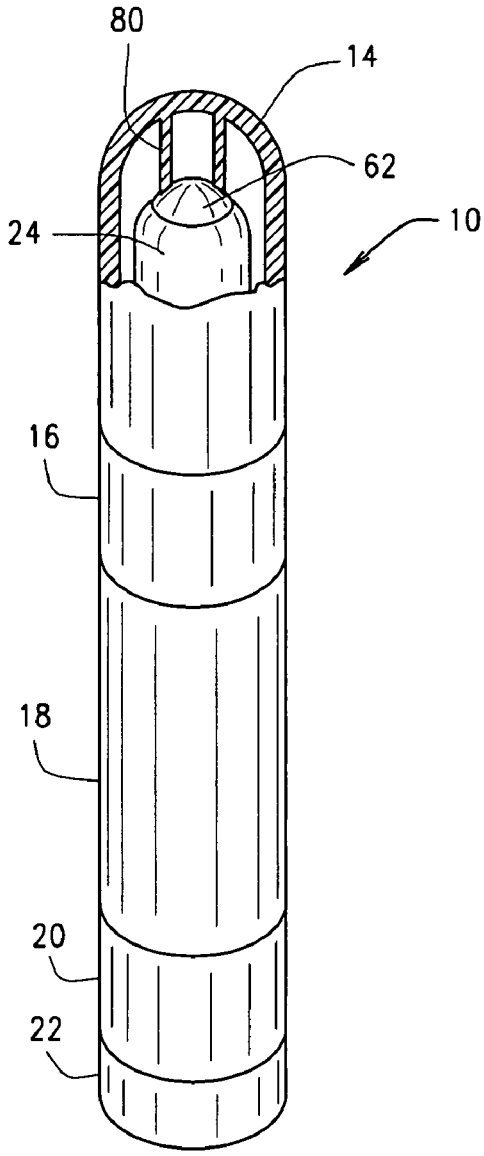
FIG. 4 is a partial cross sectional front view of the massager device according to the present invention.
Figure 5:
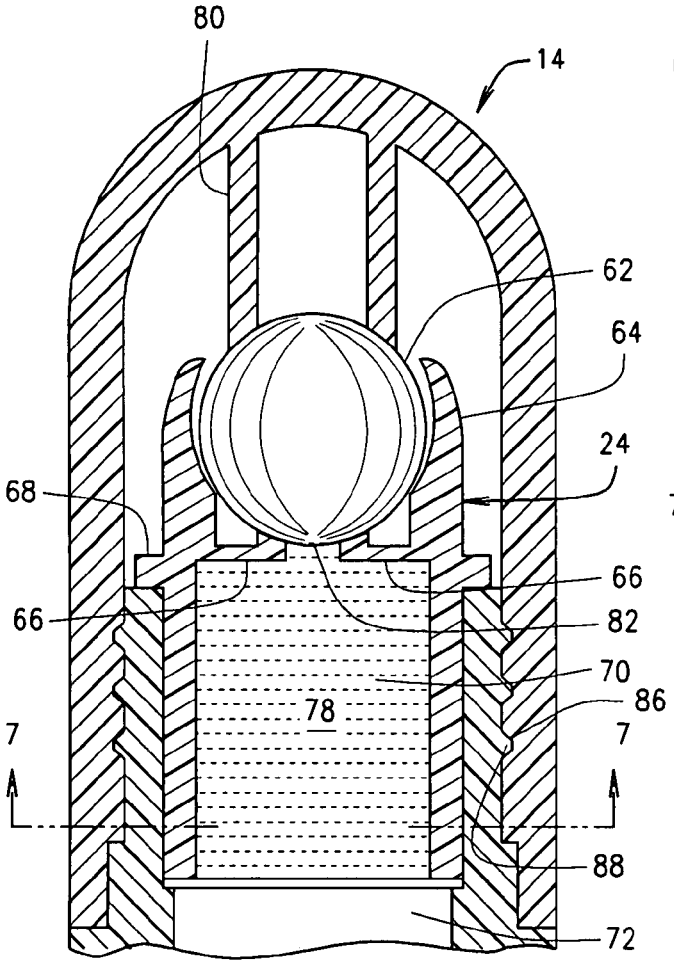
FIG. 5 is an enlarged cross sectional view of the massager device showing the massage head and liquid dispensing component according to the present invention.
Figure 6:
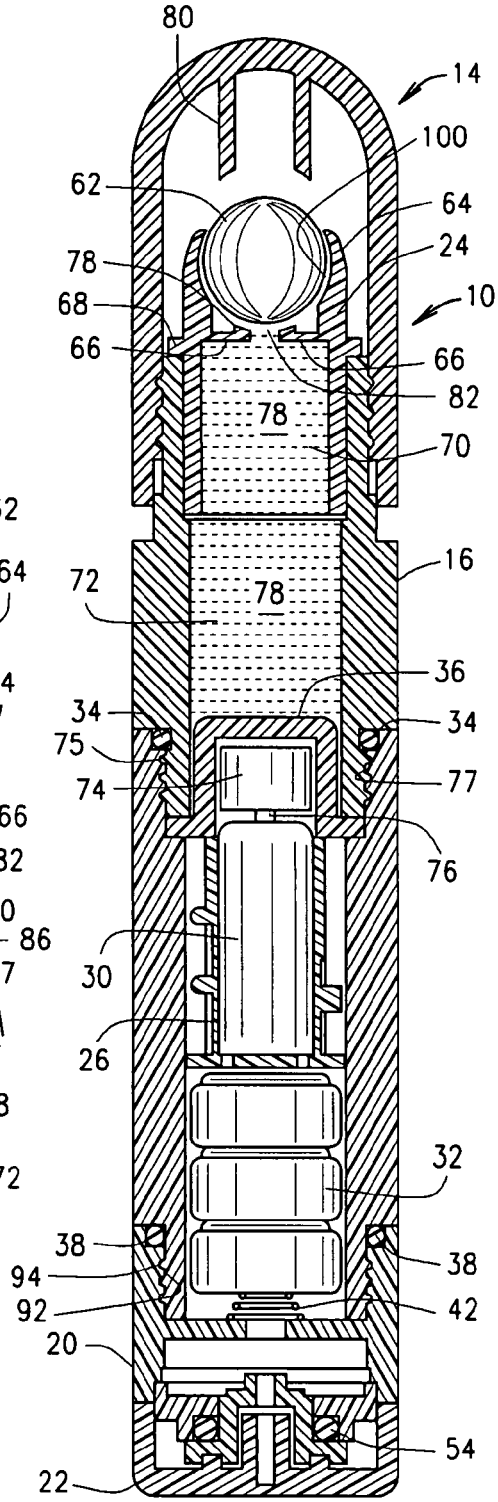
FIG. 6 is a cross-sectional view taken along line 6-6 of FIG. 1 according to the present invention.
Figure 7:
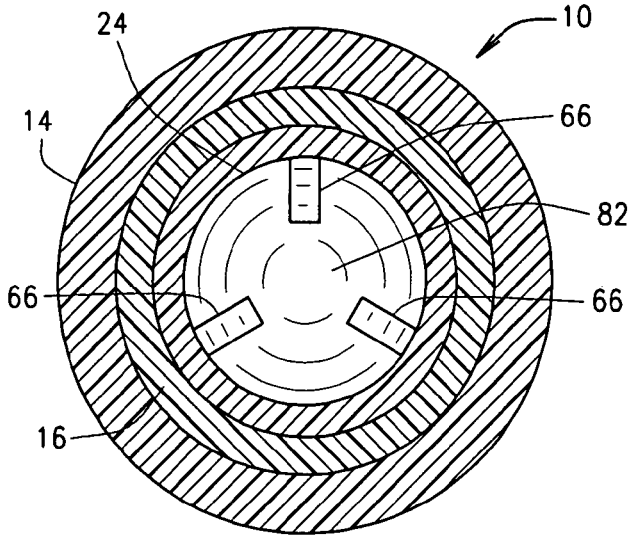
FIG. 7 is a cross-sectional view taken along line 7-7 of FIG. 5 according to the present invention.

Referring to FIGS. 2 and 3, the reservoir 16 is engaged to a liquid dispensing component 24 that permits the dispensation of liquid 78 (FIG. 6) by the user when the massage head 14 is removed from the massager device 10. The liquid dispensing component 24 comprises a seat portion 64 that is rotatably engaged to a rolling dispensing ball 62 adapted to dispense liquid 78. As shown in FIGS. 5 and 6, a portion of the dispensing ball 62 is in fluid flow communication with liquid 78 stored in a chamber 70 through an opening 82 having a plurality of retainers 66 defined within the seat portion 64 of liquid dispensing component 24. The seat portion 64 is sized and shaped to engage the dispensing ball 62 such that ball 62 rotates within the seat portion 64. In this structural arrangement, liquid 78 from chamber 70 is permitted to lubricate and cover the dispensing ball 62 through a gap 100 defined between the dispensing ball 62 and seat portion 64 as the ball 62 rotates while also preventing liquid 78 from freely flowing outwardly from between the ball 62 and gap 100.

As further shown, the reservoir 16 defines a storage chamber 72 in fluid flow communication with chamber 70 when the reservoir 16 is engaged to the liquid dispensing component 24. A flange 68 is defined around the liquid dispensing component 24 that is adapted to engage the top portion of the reservoir 16, while external threads 88 are defined around one end of the reservoir 16 for engagement with corresponding internal threads 86 defined along the interior portion of massage head 14.

Figure 8:
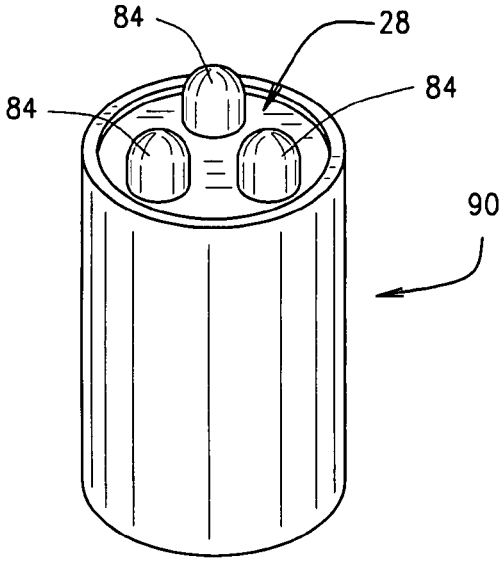
FIG. 8 is an elevated perspective view of an embodiment of the massage head according to the present invention.

Referring specifically to FIG. 5, the interior portion of the massage head 14 defines a circular contact portion 80 that extends partially downwardly through the interior of head 14 and is adapted to contact the dispensing ball 62 when the massage head 14 is securely engaged to the reservoir 16 in order to lock the dispensing ball 62 securely in place. Preferably, massage head 14 has a smooth cylindrical shape adapted to apply a massage effect when the vibratory component 18 is operated. In the alternative, the massage head 14 has several other embodiments adapted to provide a massage effect to the user. As illustrated in FIGS. 2A and 8 the present invention contemplates an alternative massage head 14A engaged to a front bit 28 for providing a massage effect. The massage head 14A comprises a hollow cylindrical casing 90 engaged to the front bit 28 at one end with the bit 28 defining a plurality of nub-like protrusions 84 adapted to enhance the massage effect provided by massager device 10.

Figure 9:
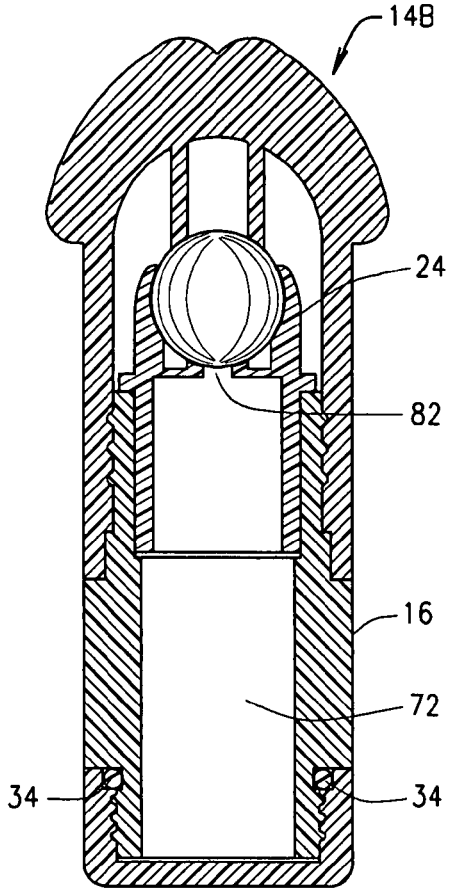
FIG. 9 is a cross sectional view of another embodiment of the massage head showing the massager device in a liquid dispensation configuration according to the present invention.

In another alternative embodiment shown in FIGS. 2A and 9, the present invention contemplates a massage head 14B having a generally phallic shape that is rotatably engaged to the reservoir 16 in a manner similar to the other two embodiments. The massage head 14B operates like massage heads 14 and 14A, which are used to encapsulate the liquid dispensing component 24 and provide a surface for imparting a massage effect to the user when the vibratory component 18 is in operation. Although massage head 14B has a phallic shape, other shapes and sizes suitable for a massaging surface are felt to fall within the scope of the present invention.

As illustrated in FIGS. 2 and 6, one end of the reservoir 16 defines exterior threads 75 adapted to engage interior threads 77 defined along the interior of vibratory component 18 which encases a vibrating element 26. The vibrating element 26 is operatively engaged to a battery 32 for providing power to element 26 and further includes a negative electrical pole 58 and a positive electrical pole 60 that provide an electrical circuit between the battery 32 and vibrating element 26. In addition, a cap member 36 and a sealing element 34 are interposed between the vibratory component 18 and the reservoir 16 for providing a fluid-tight seal such that fluid 78 from chamber 72 in reservoir 16 does not leak into the vibratory component 18 as well as providing an access port for permitting the user to re-fill chamber 72 with liquid 78. As further shown, vibrating element 26 comprises a motor casing 27 that encases a motor 30 that is operatively engaged to a rod 76 which rotates and spins an eccentric mass 74. The spinning action of the eccentric mass 74 by motor 30 causes the vibratory component 18 to vibrate during operation and provide a massaging effect. A spring 42 and contact plate 40 arrangement support the bottom portion of battery 32 in addition to a sealing element 38 that provides a water-tight seal between the vibratory component 18 and battery cover 20.

The other end of the vibratory component 18 defines exterior threads 92 adapted to engage interior threads 94 of battery cover 20. As shown in FIG. 2, the battery cover 20 encases a PCB component 48, locating ring 50, and contacting plate 52 when assembled, while a sealing ring 54 is provided between the battery cover 20 and end cap 22 for providing a fluid tight seal. As further shown, a sleeve bearing 56 is seated within end cap 22 for aligning and engaging the end cap 22 with battery cover 20.

In operation, the user may engage any one of the massage heads 14, 14A or 14B to the reservoir 16 when using the massager device 10 as a vibrator. In the alternative, the user may disengage the massage head 14 from the reservoir 16 and use the liquid dispensing component 24 to apply liquid 78 by rolling the dispensing ball 62 along the skin. The rolling action of the dispensing ball 62 along the skin continually lubricates and covers the outer surface of dispensing ball 62 with liquid 78 stored in chamber 70 for application by the user. In addition, the vibratory element 26 may be activated by rotating the end cap 22 so that the massager device 10 may be used to apply liquid 78 while simultaneously providing a massaging effect to the user if desired. Accordingly, the massager device 10 may be used to apply a liquid 78, such as an oil or other suitable liquid, while also effecting a massaging function using the massager device 10.

In the alternative, as shown in FIG. 9, the reservoir 16 may be directly engaged to the end cap 22 without the vibrating component 18 such that massager device 10 may be used solely as a liquid applicator.

It should be understood from the foregoing that, while particular embodiments of the invention have been illustrated and described, various modifications can be made thereto without departing from the spirit and scope of the invention as will be apparent to those skilled in the art. Such changes and modifications are within the scope and teaching of this invention as defined in the claims appended hereto.

What is claimed is:

1. A massager device comprising:

a massage head adapted to engage a reservoir that includes a chamber for storing a liquid and to be switched with a plurality of other massage heads each having a different outward appearance;

a liquid dispensing component in communication with said reservoir for dispensing said liquid over a dispensing ball;

at least one retainer included in said liquid dispensing component between said chamber and said dispensing ball, wherein said massage head includes a portion adapted to contact said dispensing ball when said massage head is engaged with said reservoir to cause said dispensing ball to contact said retainer to prevent said liquid from being dispensed over said dispensing ball;

a vibratory component engaged to said reservoir, said vibratory component including a motor that causes the vibratory component to vibrate;

a sealing element interposed between the vibratory component and the reservoir for providing a fluid-tight seal between the vibratory component and the reservoir; and an end cap operatively engaged to said vibratory component for controlling the operation of the massager device, wherein said massage head includes a hollow cylindrical casing engaged to a front bit, said front bit defining a plurality of nub-like protrusions.

2. The massager device according to claim 1, wherein said liquid dispensing component includes a seat portion defining an opening in communication with said chamber, said seat portion adapted to rotatably engage a dispensing ball for dispensing said liquid.

3. The massager device according to claim 2, wherein a portion of said dispensing ball is in communication with said liquid such that said liquid covers said dispensing ball for application of said liquid when said dispensing ball is rotated.

4. The massager device according to claim 2, wherein said dispensing ball is rotatable within said seat portion.

5. The massager device according to claim 2, wherein a portion of said dispensing ball is adapted to be in contact with said liquid in said chamber and is capable of dispensing said liquid as said dispensing ball rotates and is exposed externally from said chamber.

6. The massager device according to claim 2, wherein a gap is defined between said dispensing ball and said seat portion, said gap permitting a layer of said dispensing ball to be lubricated and covered with said liquid but preventing the free flow of fluid therethrough.

7. The massager device according to claim 1, wherein said liquid dispensing component provides a means for applying said liquid while also providing a massage effect when said massage head is disengaged from said reservoir.

8. The massager device according to claim 1, wherein said motor is operatively engaged to a rod for rotating an eccentric mass.

9. The massager device according to claim 1, wherein said massage head has a generally phallic shape.

10. The massager device according to claim 1, wherein said reservoir is engaged to a cap member for accessing said chamber.

11. The massager device according to claim 1, wherein said dispensing ball is prevented from oscillating when said contact portion contacts said dispensing ball.

12. A massager device comprising:

a massage head adapted to engage a reservoir that includes a chamber for storing a liquid and to be switched with a plurality of other massage heads each having a different outward appearance;

a liquid dispensing component in communication with said reservoir for dispensing said liquid over a dispensing ball;

at least one retainer included in said liquid dispensing component between said chamber and said dispensing ball, wherein said massage head includes a portion adapted to contact said dispensing ball when said massage head is engaged with said reservoir to cause said dispensing ball to contact said retainer to prevent said liquid from being dispensed over said dispensing ball;

a vibratory component engaged to said reservoir, said vibratory component including a motor that causes the vibratory component to vibrate;

a sealing element interposed between the vibratory component and the reservoir for providing a fluid-tight seal between the vibratory component and the reservoir;

an end care operatively engaged to said vibratory component for controlling the operation of the massager device; and a cap member between said vibratory component and said reservoir, wherein said cap member and said sealing element prevent said liquid from leaking from said chamber into said vibratory component, wherein said chamber is adapted to be re-filled with said liquid by removing said cap member.

13. A massager device comprising:

a reservoir that includes a chamber for storing a liquid;

a liquid dispensing component engaged to said reservoir for dispensing said liquid over a dispensing ball;

a massage head adapted to be switched with any of a plurality of other massage heads each having a different outward appearance;

at least one retainer included in said liquid dispensing component between said chamber and said dispensing ball, wherein said massage head includes a portion adapted to contact said dispensing ball when said massage head is engaged with said reservoir so that said dispensing ball contacts said retainer to prevent said liquid from being dispensed over said dispensing ball;

a vibratory component engaged to said reservoir, said vibratory component including a motor that causes the vibratory component to vibrate; and a sealing element interposed between the vibratory component and the reservoir for providing a fluid-tight seal between the vibratory component and the reservoir, wherein the massager device is adapted to dispense said liquid and provide a massaging effect at the same time; and a cap member between said vibratory component and said reservoir, wherein said cap member and said sealing element prevent said liquid from leaking from said chamber into said vibratory component, said cap member being removable from said reservoir for permitting said chamber to be re-filled with said liquid.

14. The massager device according to claim 13, further comprising an end cap engaged to said reservoir for controlling the operation of the massager device.

15. The massager device according to claim 13, wherein said liquid dispensing component is in fluid flow communication with said liquid stored in said chamber.

16. The massage device according to claim 13, wherein said liquid dispensing component comprises a dispensing ball rotatably engaged to a seat portion, said dispensing ball in fluid flow communication with said liquid for dispensing said liquid.

17. The massager device according to claim 13, wherein said dispensing ball is prevented from oscillating when said contact portion contacts said dispensing ball.

18. A massager device comprising:

a massage head adapted to engage a reservoir defining a chamber for storing a liquid;

a liquid dispensing component in communication with said reservoir for dispensing said liquid over a dispensing ball, said reservoir including a care member being removable from said reservoir for permitting said chamber to be refilled with said liquid;

at least one retainer configured to contact said dispensing ball and prevent said liquid from being dispensed over said ball; and a sealing element interposed between a vibratory component and the reservoir for providing a fluid-tight seal between the vibratory component and the reservoir, the vibratory component including a motor that causes the vibratory component to vibrate;

wherein said vibratory component is engaged to said reservoir for providing a massaging effect, and wherein said massage head has a generally phallic shape, is adapted to be switched with at least one other massage head having a different outward appearance, and includes a portion adapted to contact said dispensing ball and push said ball to contact said retainer when said massage head is engaged to said reservoir; and wherein the cap member is located between said reservoir and said vibratory component and prevents said liquid from leaking from said chamber into said vibratory component.

19. The massager device according to claim 18, wherein said dispensing ball is prevented from oscillating when said contact portion contacts said dispensing ball.

* * * * *

UNITED STATES PATENT AND TRADEMARK OFFICE

CERTIFICATE OF CORRECTION

PATENT NO. : 7,699,795 B2
APPLICATION NO. : 11/157630
DATED : April 20, 2010
INVENTOR(S) : Simon Siu Man Nan It is certified that error appears in the above-identified patent and that said Letters Patent is hereby corrected as shown below:

Col. 3, line 16: “8” should read -- 8, --

Claim 12, col. 5, line 46: “care” should read -- cap --

Claim 18, col. 6, line 37: “care” should read -- cap --

Signed and Sealed this
Seventh Day of February, 2012

David J. Kappos

David J. Kappos
*Director of the United States Patent and Trademark Office*